US009627805B2

(12) United States Patent
Matsuda et al.

(10) Patent No.: US 9,627,805 B2
(45) Date of Patent: Apr. 18, 2017

(54) RECEPTACLE PROTECTION COVER AND ELECTRONIC DEVICE

(71) Applicant: Mitsubishi Electric Corporation, Tokyo (JP)

(72) Inventors: Kensaku Matsuda, Tokyo (JP); Hidenori Suzuki, Tokyo (JP); Takanobu Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/783,116

(22) PCT Filed: Apr. 25, 2013

(86) PCT No.: PCT/JP2013/062188

§ 371 (c)(1),
(2) Date: Oct. 8, 2015

(87) PCT Pub. No.: WO2014/174628

PCT Pub. Date: Oct. 30, 2014

(65) Prior Publication Data

US 2016/0072223 A1 Mar. 10, 2016

(51) Int. Cl.
*H01R 13/00* (2006.01)
*H01R 13/627* (2006.01)
(Continued)

(52) U.S. Cl.
CPC ..... *H01R 13/627* (2013.01); *H01R 13/447* (2013.01); *H01R 13/631* (2013.01);
(Continued)

(58) Field of Classification Search
USPC ..... 439/297, 476.1, 478, 480, 481, 483
See application file for complete search history.

(56) References Cited

U.S. PATENT DOCUMENTS 3,654,589 A * 4/1972 Di Stefano ..... H01R 13/112 439/483
4,941,841 A * 7/1990 Darden ..... G06F 1/184 361/679.39
(Continued)

FOREIGN PATENT DOCUMENTS

JP 2001-266993 A 9/2001
JP 2003-004983 A 1/2003
(Continued)

OTHER PUBLICATIONS

Taiwan Examination Report for corresponding Taiwanese Application No. 102142588.
(Continued)

*Primary Examiner* — Tho D Ta
(74) *Attorney, Agent, or Firm* — Sughrue Mion, PLLC; Richard C. Turner

(57) ABSTRACT

A receptacle protection cover that is attachable to and detachable from a casing of an electronic device including a receptacle into which a plug is inserted, and that protects the receptacle provided in a concave part by covering the concave part formed in the casing, includes: a rectangular plate-shaped cover plate; and a plug attachment part that is provided on an inner side face of the cover plate and that fixes the plug such that a terminal part of the plug projects from one end or the other end of the cover plate in a longitudinal direction, wherein as the receptacle protection cover is detached from the casing, the receptacle protection cover serves as a jig for inserting the plug attached to the plug attachment part into the receptacle.

7 Claims, 13 Drawing Sheets

(51) Int. Cl.

| | |
|---|---|
| ***H01R 43/26*** | (2006.01) |
| ***H01R 13/447*** | (2006.01) |
| ***H01R 13/631*** | (2006.01) |
| *H01R 13/629* | (2006.01) |
| *H01R 13/633* | (2006.01) |

(52) U.S. Cl.
CPC ..... *H01R 43/26* (2013.01); *H01R 13/629* (2013.01); *H01R 13/6335* (2013.01)

(56) References Cited

U.S. PATENT DOCUMENTS

| | | | | |
|---|---|---|---|---|
| 5,405,271 | A * | 4/1995 | Bauer | H01F 38/10 29/758 |
| 7,384,299 | B1 * | 6/2008 | Bridges | H01R 13/5812 439/354 |
| 7,637,768 | B1 | 12/2009 | Hsu | |
| 7,901,237 | B2 * | 3/2011 | Abe | H01R 43/26 439/354 |
| 2009/0049685 | A1 * | 2/2009 | Barina | H01R 13/6335 29/786 |
| 2011/0173364 | A1 | 7/2011 | Tsugaru et al. | |

FOREIGN PATENT DOCUMENTS

| | | | |
|---|---|---|---|
| JP | 2007-286733 | A | 11/2007 |
| JP | 2009-054510 | A | 3/2009 |
| JP | 2010-055363 | A | 3/2010 |
| TW | I344242 | B | 6/2011 |

OTHER PUBLICATIONS

International Search Report for PCT/JP2013/062188 dated Jul. 30, 2013.
Communication dated Nov. 9, 2016 from the European Patent Office in counterpart European application No. 13882872.8.

* cited by examiner

RECEPTACLE PROTECTION COVER AND ELECTRONIC DEVICE

CROSS REFERENCE TO RELATED APPLICATIONS

This application is a National Stage of International Application No. PCT/JP2013/062188 filed Apr. 25, 2013, the contents of all of which are incorporated herein by reference in their entirety.

FIELD

The present invention relates to a receptacle protection cover that protects a receptacle included in an electronic device and to an electronic device that connects a plug and a receptacle.

BACKGROUND

Conventionally, when a plug is inserted into a receptacle (such as a USB (Universal Serial Bus)) provided in a device, the terminal part of the plug is inserted into the receptacle while one grips the housing of the plug with one's fingers; however, if the receptacle is provided at a deeply recessed position of the device, the fingers cannot reach the receptacle. In such a case, the terminal part is inserted into the receptacle while gripping the cable part; however, because the cable part is flexible, the insertion direction cannot be settled, and thus it is difficult to insert the terminal part into the receptacle.

When two receptacles are provided at a deeply recessed position, the receptacles are difficult to see, and thus there is a possibility that a terminal part is erroneously inserted into an unintended receptacle.

Furthermore, when a locking mechanism is not provided in a plug, the plug is held in place only by the contact pressure to the receptacle; therefore, the plug easily comes out when it is pulled. If the plug comes out during communication, there is a possibility that a device will operate erroneously or malfunction.

Patent Literature 1 discloses a configuration for preventing a cable housing from coming out of a connector (a plug from coming out of a receptacle) even when a force is applied to a cable in a direction in which the plug comes out.

CITATION LIST

Patent Literature

Patent Literature 1: Japanese Patent Application Laid-open No. 2001-266993

SUMMARY

Technical Problem

However, with the technique disclosed in Patent Literature 1 listed above, although it is possible to prevent a plug from coming out of a receptacle, if it is difficult to grip the housing when the plug is inserted into the receptacle, the problem with holding the cable part to insert the plug into the receptacle remains.

The present invention has been achieved in view of the above problem, and an object of the present invention is to provide a receptacle protection cover and an electronic device in which, even when a receptacle is provided at a deeply recessed position, a plug can be easily inserted into the receptacle.

Solution to Problem

In order to solve the above problems and achieve the object, an aspect of the present invention is a receptacle protection cover that is attachable to and detachable from a casing of an electronic device including a receptacle into which a plug is inserted, and that protects the receptacle provided in a concave part by covering the concave part formed in the casing, the receptacle protection cover including: a rectangular plate-shaped cover plate; and a plug attachment part that is provided on one face of the cover plate and that fixes the plug such that a terminal part of the plug projects from an end part of the cover plate in a longitudinal direction, wherein as the receptacle protection cover is detached from the casing, the receptacle protection cover serves as a jig for inserting the plug attached to the plug attachment part into the receptacle.

Advantageous Effects of Invention

In the receptacle protection cover and the electronic device according to the present invention, an effect is obtained where even when a receptacle is provided at a deeply recessed position, a plug can be easily inserted into the receptacle.

DESCRIPTION OF EMBODIMENTS

Exemplary embodiments of a receptacle protection cover according to the present invention will be explained below in detail with reference to the drawings. The present invention is not limited to the embodiments.

Embodiment

Figure 1A:
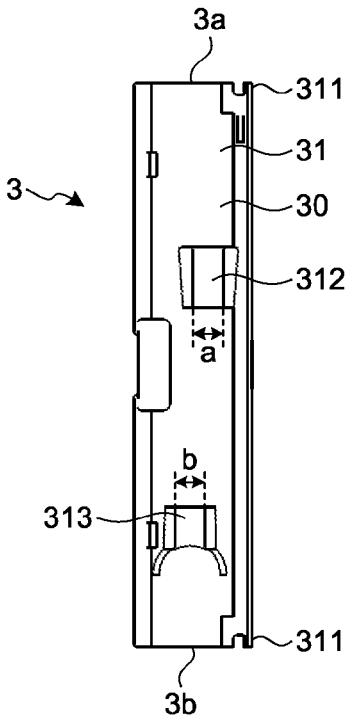
FIG. 1A is a diagram illustrating a configuration of a receptacle protection cover according to an embodiment of the present invention.
Figure 1B:
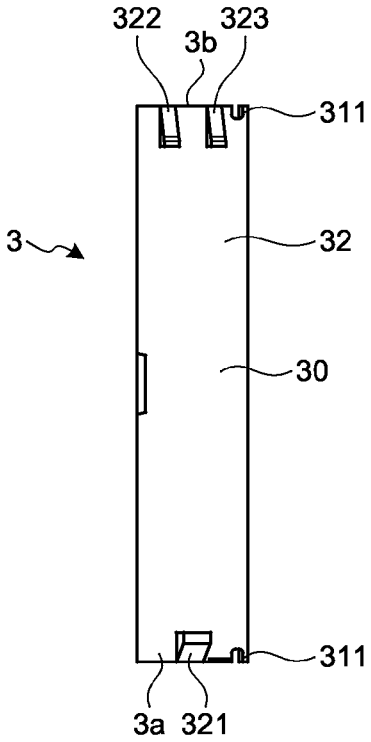
FIG. 1B is a diagram illustrating a configuration of the receptacle protection cover according to the embodiment of the present invention.

FIGS. 1A and 1B are diagrams each illustrating a configuration of a receptacle protection cover according to an embodiment of the present invention. A receptacle protection cover 3 includes a substantially rectangular plate-shaped cover plate 30. Bearing parts 311 and plug attachment parts 312 and 313 are provided on an inner side face 31 of the cover plate 30, and engagement projections 321, 322, and 323 are provided on an outer side face 32 thereof.

The plug attachment part 312 and the plug attachment part 313 are provided at positions having different distances in the longitudinal direction from the end parts of the cover plate 30. Specifically, the distance between the plug attachment part 312 and one end 3*a* of the cover plate 30 in the longitudinal direction is longer than the distance between the plug attachment part 313 and the other end 3*b* of the cover plate 30 in the longitudinal direction. The engagement projection 321 is provided at the one end 3*a* of the cover plate 30 in the longitudinal direction, and the engagement projections 322 and 323 are provided at the other end 3*b*. The bearing parts 311 are provided such that one of them is at the one end 3*a* of the cover plate 30 in the longitudinal direction and the other one of them is at the other end 3*b* of the cover plate 30 in the longitudinal direction. A width "a" of the plug attachment part 312 is set to be larger than a width "b" of the plug attachment part 313.

Figure 2:
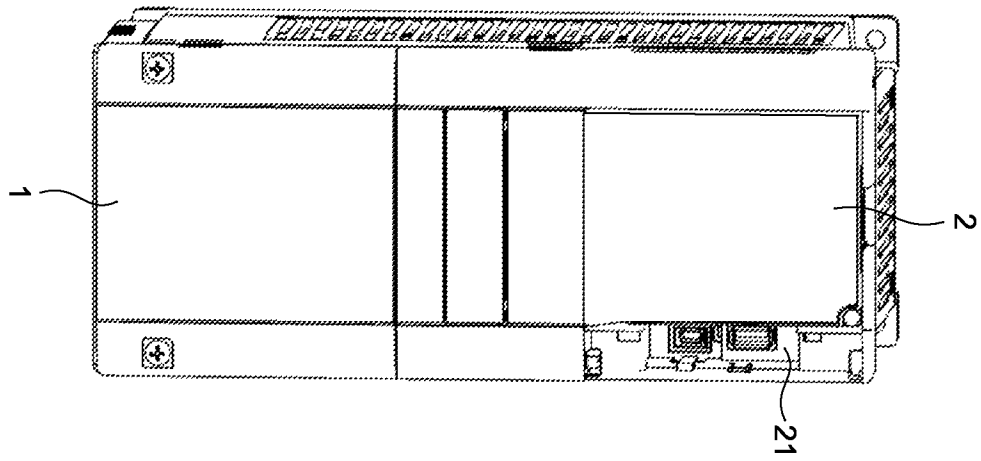
FIG. 2 is a diagram illustrating a configuration of an electronic device in which the receptacle protection cover according to the embodiment is used.
Figure 3:
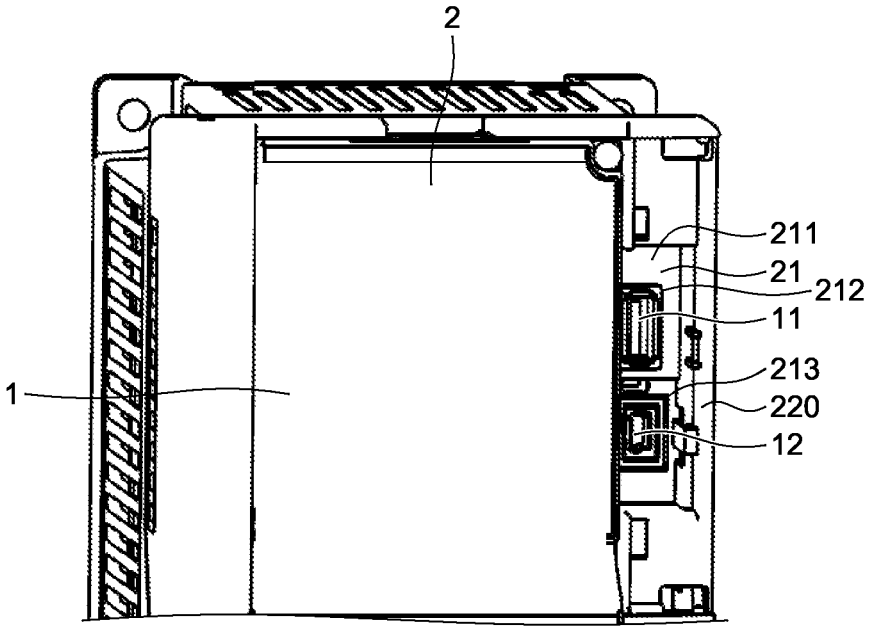
FIG. 3 is a partial enlarged view around a concave part of the electronic device in which the receptacle protection cover is used.
Figure 4:
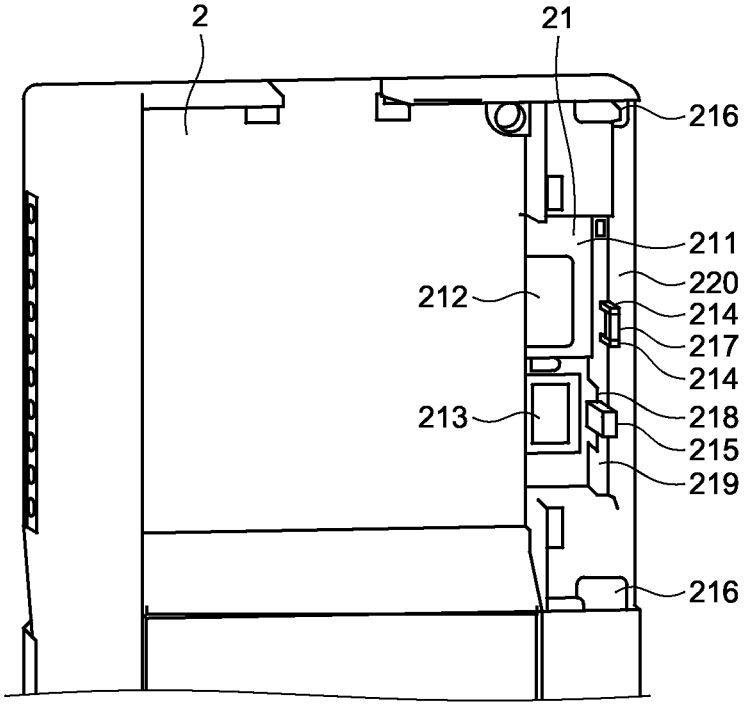
FIG. 4 is a partial enlarged view around a concave part of a front cover of the electronic device in which the receptacle protection cover is used.

FIG. 2 is a diagram illustrating a configuration of an electronic device in which the receptacle protection cover according to the embodiment is used. FIG. 3 is a partial enlarged view around a concave part of the electronic device in which the receptacle protection cover is used. FIG. 4 is a partial enlarged view around a concave part of a front cover of the electronic device in which the receptacle protection cover is used. In an electronic device 1, a part of a casing thereof is constituted by a front cover 2. On the front cover 2, there is a concave part 21 that is concave so that a substantially rectangular bottom face 211 is surrounded by an inner wall 220. The electronic device 1 includes two receptacles 11 and 12 having different shapes. The receptacles 11 and 12 are provided such that plugs 4 and 5, described later, are insertable and removable through plug insertion holes 212 and 213, which are described later and are provided in the bottom face 211 of the concave part 21.

The receptacle protection cover 3 protects the receptacles 11 and 12 as the receptacle protection cover 3 is attached to the front cover 2 so as to cover the concave part 21.

Figure 5A:
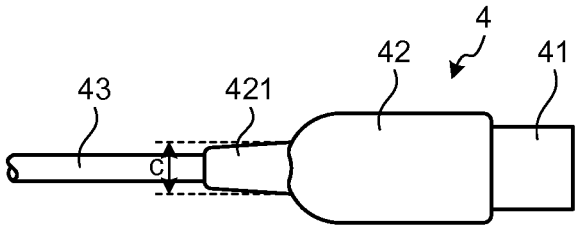
FIG. 5A is a diagram illustrating a configuration of a plug that is inserted into a receptacle.
Figure 5B:
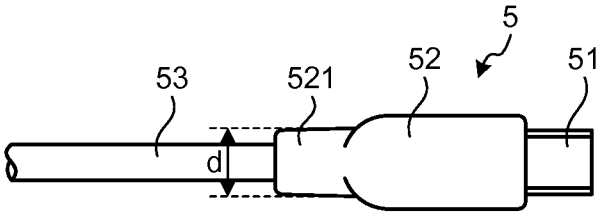
FIG. 5B is a diagram illustrating a configuration of a plug that is inserted into a receptacle.

FIGS. 5A and 5B are diagrams each illustrating a configuration of a plug that is inserted into a receptacle, where FIG. 5A illustrates the configuration of the plug 4 that is inserted into the receptacle 11 and FIG. 5B illustrates the configuration of the plug 5 that is inserted into the receptacle 12. The plug 4 includes a terminal part 41, a housing 42, and a cable part 43. The terminal part 41 is a portion that is inserted into the receptacle 11 to make the electrical connection. The housing 42 is a portion that protects a connecting portion between the terminal part 41 and the cable part 43, and the housing 42 is provided with a tension relieving part 421 on the cable part 43 side. The tension relieving part 421 relieves the tension created around the boundary between the housing 42 and the cable part 43 when the cable part 43 is bent. The cable part 43 is connected to a device as a communication counterpart or to a plug connected to the device. The plug 5 includes a terminal part 51, a housing 52, and a cable part 53. The terminal part 51 is a portion that is inserted into the receptacle 12 to make the electrical connection. The housing 52 is a portion that protects a connecting portion between the terminal part 51 and the cable part 53, and the housing 52 is provided with a tension relieving part 521 on the cable part 53 side. The tension relieving part 521 relieves the tension created around the boundary between the housing 52 and the cable part 53 when the cable part 53 is bent. The cable part 53 is connected to a device as a communication counterpart or to a plug connected to the device. Because the receptacle 11 and the receptacle 12 have different shapes, respective parts of the plug 4 and the plug 5 that are inserted into the receptacles 11 and 12 have different shapes and different sizes. In this example, the housing 42 of the plug 4 is assumed to be wider and longer than the housing 52 of the plug 5.

A width "c" of the tension relieving part 421 is substantially equal to the width "a" of the plug attachment part 312 ($c \cong a$). A width "d" of the tension relieving part 521 is substantially equal to the width "b" of the plug attachment part 313 ($d \cong b$).

Figure 6:
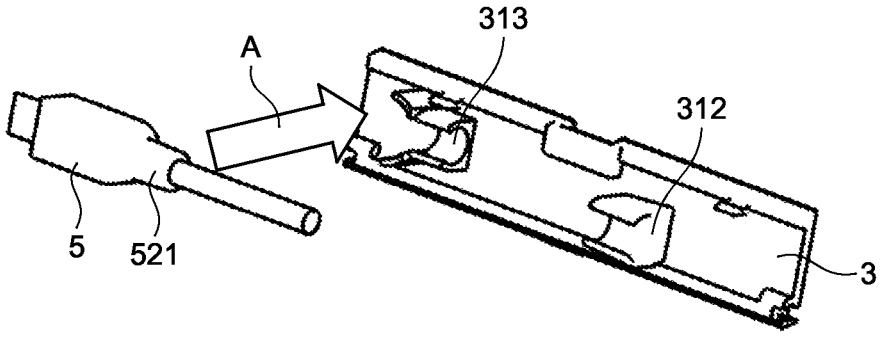
FIG. 6 is a diagram illustrating a state where a plug is being fitted into a plug attachment part.

Because the width "c" of the tension relieving part 421 is substantially equal to the width "a" of the plug attachment part 312, the plug 4 is fixed to the receptacle protection cover 3 as the tension relieving part 421 is fitted into the plug attachment part 312. Because the width "d" of the tension relieving part 521 is substantially equal to the width "b" of the plug attachment part 313, the plug 5 is fixed to the receptacle protection cover 3 as the tension relieving part 521 is fitted into the plug attachment part 313. FIG. 6 is a diagram illustrating a state where a plug is being fitted into a plug attachment part. The plug 5 is fixed to the receptacle protection cover 3 as the tension relieving part 521 is inserted into the plug attachment part 313 in the direction of arrow A so as to attach the plug 5 to the receptacle protection cover 3.

The front cover 2 includes, in the concave part 21, shaft parts 216, the plug insertion holes 212 and 213, guides 214 and 215, and engagement concave parts 217, 218, and 219. The engagement concave part 217 is provided in a portion adjacent to the plug insertion hole 212 of the inner wall 220, and the engagement concave parts 218 and 219 are provided in a portion adjacent to the plug insertion hole 213 of the inner wall 220. A pair of guides 214 is provided in a rib shape to sandwich the engagement concave part 217 therebetween, and the guide 215 is provided in a rib shape between the engagement concave parts 218 and 219. The plug insertion holes 212 and 213 are provided in the bottom face 211 of the concave part 21, and thus the plugs 4 and 5 are insertable into the receptacles 11 and 12 within the electronic device 1 through the plug insertion holes 212 and 213.

Figure 7A:
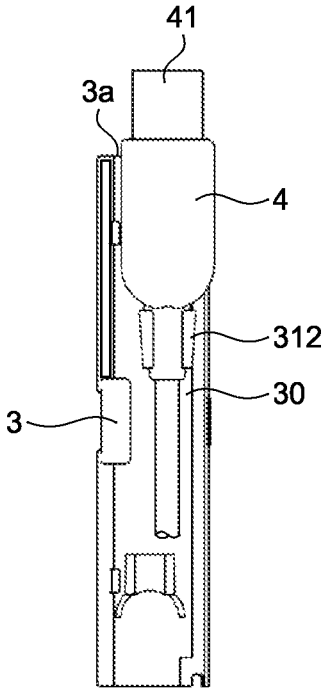
FIG. 7A is a plan view illustrating a state where a plug has been attached to a plug attachment part.
Figure 7B:
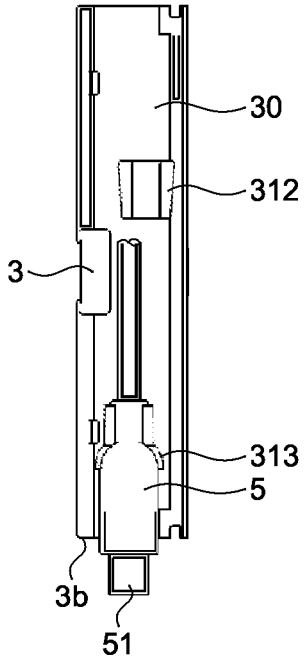
FIG. 7B is a plan view illustrating a state where a plug has been attached to a plug attachment part.
Figure 8A:
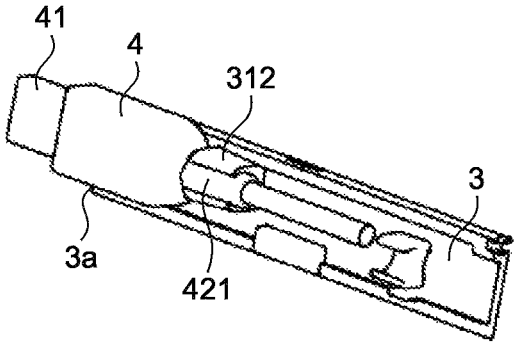
FIG. 8A is a perspective view illustrating a state where a plug has been attached to a plug attachment part.
Figure 8B:
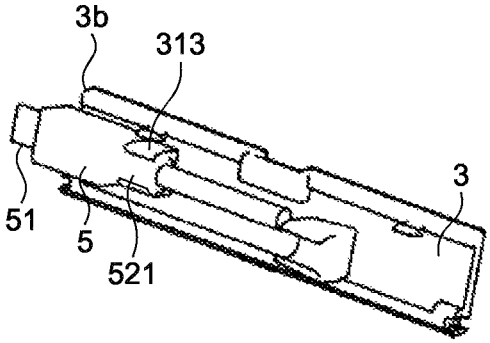
FIG. 8B is a perspective view illustrating a state where a plug has been attached to a plug attachment part.

FIGS. 7A and 7B are plan views each illustrating a state where a plug has been attached to a plug attachment part, where FIG. 7A illustrates a state where the plug 4 has been attached to the plug attachment part 312 and FIG. 7B illustrates a state where the plug 5 has been attached to the plug attachment part 313. FIGS. 8A and 8B are perspective views each illustrating a state where a plug has been attached to a plug attachment part, where FIG. 8A illustrates a state where the plug 4 has been attached to the plug attachment part 312 and FIG. 8B illustrates a state where the plug 5 has been attached to the plug attachment part 313. By attaching the plug 4 to the plug attachment part 312, a portion of the terminal part 41 projects from the one end 3*a* of the cover plate 30 in the longitudinal direction. Furthermore, by attaching the plug 5 to the plug attachment part 313, a portion of the terminal part 51 projects from the other end 3*b* of the cover plate 30 in the longitudinal direction.

Figure 9A:
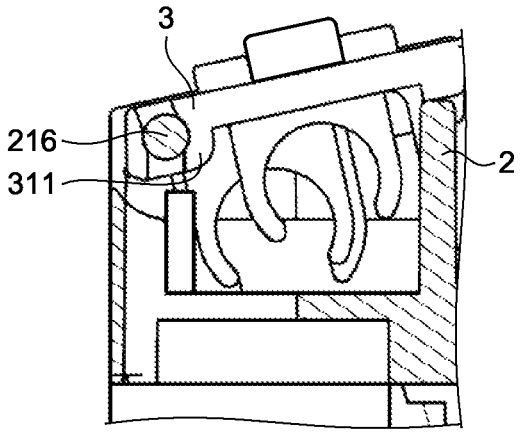
FIG. 9A is a partial cross-sectional view of an electronic device with a receptacle protection cover in a closed state.
Figure 9B:
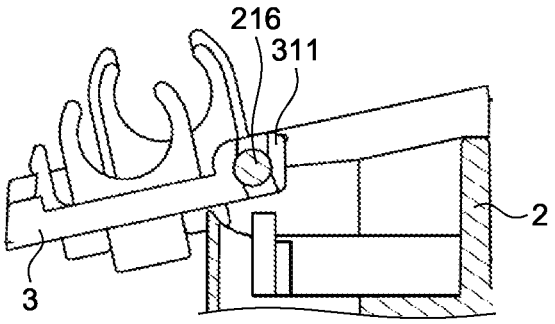
FIG. 9B is a partial cross-sectional view of the electronic device with the receptacle protection cover in an open state.
Figure 9C:
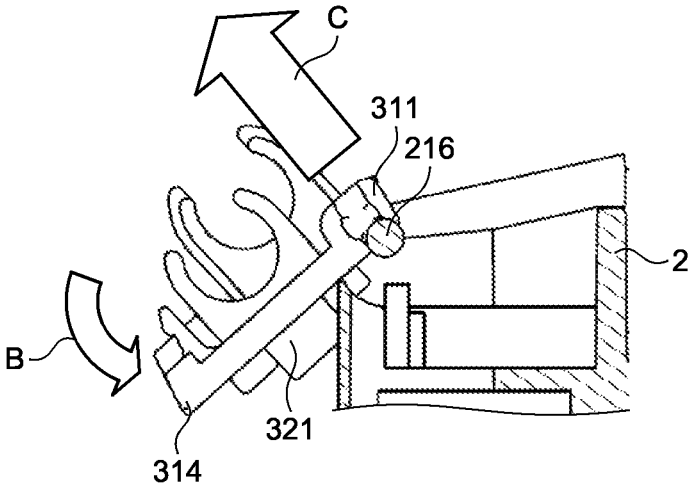
FIG. 9C is a diagram illustrating a state where the receptacle protection cover is being detached from a front cover.

By engaging the bearing parts 311 with the shaft parts 216 of the front cover 2, the receptacle protection cover 3 is pivotally supported between a closed state where the concave part 21 is covered and an open state where the concave part 21 is exposed. FIG. 9A is a partial cross-sectional view of an electronic device with a receptacle protection cover in a closed state. FIG. 9B is a partial cross-sectional view of the electronic device with the receptacle protection cover in an open state. The receptacle protection cover 3 can engage the bearing parts 311 with the shaft parts 216 or cancel the engagement therebetween in a fully open state, and thus it is possible to attach and detach the receptacle protection cover 3 to and from the front cover 2. FIG. 9C is a diagram illustrating a state where the receptacle protection cover is being detached from a front cover. In a fully open state, the engagement projection 321 formed on the outer side face 32 of the cover plate 30 is in contact with the front cover 2. Therefore, by applying a force in a direction (direction indicated by arrow B) of further opening the receptacle protection cover 3 in the fully open state to an end part 314 on the long side, which is the side opposite to the side where the bearing parts 311 of the cover plate 30 are provided, and by employing the principle of leverage in which the end part 314 is the point of effort, the engagement projection 321 is the fulcrum, and the bearing parts 311 are the points of load, the bearing parts 311 move in the direction of arrow C. With this configuration, the engagement between the shaft parts 216 and the bearing parts 311 is canceled, and the receptacle protection cover 3 is separated from the front cover 2. Commonly-known structures can be used as the bearing structure in which shaft parts and bearing parts are separable when in a fully open state.

Figure 10A:
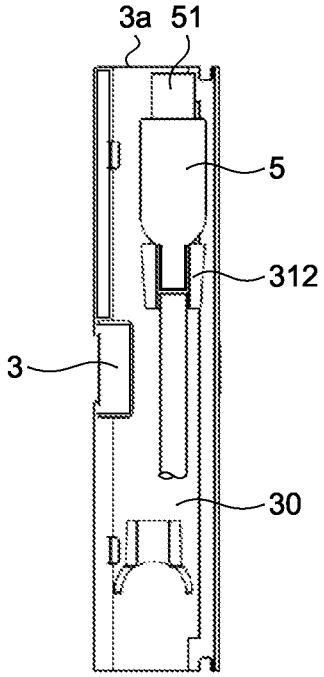
FIG. 10A is a diagram illustrating a state where a plug having a non-matching shape has been attached to a plug attachment part.
Figure 10B:
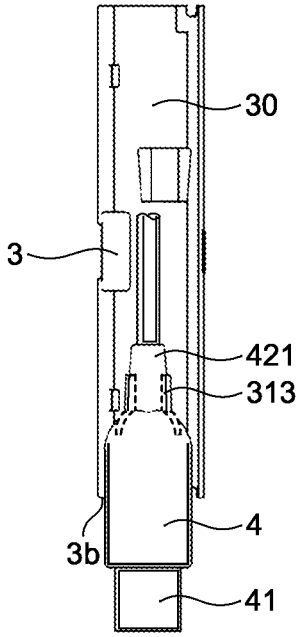
FIG. 10B is a diagram illustrating a state where a plug having a non-matching shape has been attached to a plug attachment part.

FIGS. 10A and 10B are diagrams each illustrating a state where a plug having a non-matching shape has been attached to a plug attachment part, where FIG. 10A illustrates a state where the plug 5 is attached to the plug attachment part 312 and FIG. 10B is a diagram illustrating a state where the plug 4 is attached to the plug attachment part 313. The length of the housing 52 of the plug 5 is shorter than that of the housing 42 of the plug 4, and the distance between the plug attachment part 312 and the one end 3*a* of the cover plate 30 in the longitudinal direction is longer than that between the plug attachment part 313 and the other end 3*b* of the cover plate 30 in the longitudinal direction. Therefore, when the plug 5 is attached to the plug attachment part 312, the terminal part 51 does not project from the one end 3*a* side of the cover plate 30 in the longitudinal direction. In contrast, when the plug 4 is to be attached to the plug attachment part 313, because the width of the tension relieving part 421 is larger than that of the plug attachment part 313 (c>b), the tension relieving part 421 interferes with the plug attachment part 313, so that the plug 4 cannot be inserted into the plug attachment part 313. Therefore, when the plug 4 is attached to the plug attachment part 313 and when the plug 5 is attached to the plug attachment part 312, in both cases, it is possible to easily determine that the attachment orientation is reversed. While there has been exemplified a configuration in which the plug attachment part 313 itself functions as an erroneous-attachment prevention projection by the tension relieving part 421 interfering with the plug attachment part 313, it is also possible to provide an erroneous-attachment prevention projection, which inhibits attachment of a plug having a non-matching shape, separately from the plug attachment part.

The one end 3*a* side of the cover plate 30 in the longitudinal direction engages with the engagement concave part 217 only on the plug insertion hole 212 side, and the other end 3*b* side of the cover plate 30 in the longitudinal direction engages with the engagement concave parts 218 and 219 only on the plug insertion hole 213 side. That is, the position of the engagement concave part 217 on the plug insertion hole 212 side and the positions of the engagement projections 322 and 323 on the other end 3*b* side of the cover plate 30 in the longitudinal direction do not match each other, and the positions of the engagement concave parts 218 and 219 on the plug insertion hole 213 side and the position of the engagement projection 321 on the one end 3*a* side of the cover plate 30 in the longitudinal direction do not match each other; therefore, erroneous insertion of the plugs can be prevented.

Figure 11A:
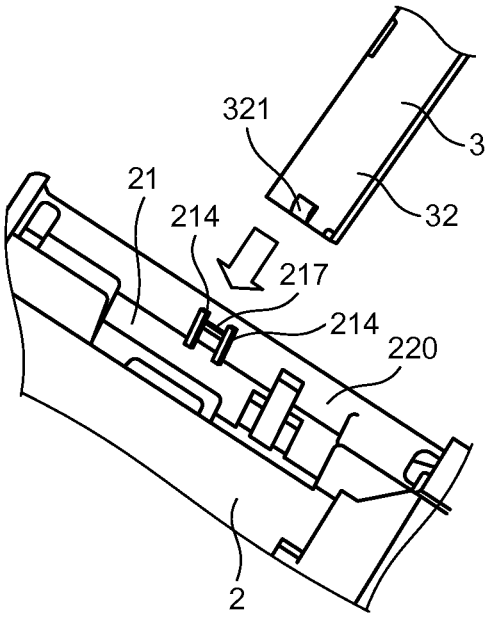
FIG. 11A is a diagram illustrating a state where one end side of a receptacle protection cover is being inserted into a concave part.
Figure 11B:
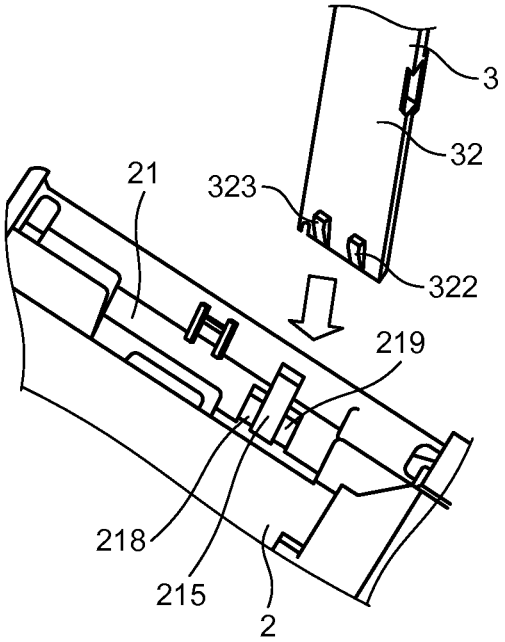
FIG. 11B is a diagram illustrating a state where the other end side of the receptacle protection cover is being inserted into a concave part.

FIG. 11A is a diagram illustrating a state where one end side of a receptacle protection cover is being inserted into a concave part. To facilitate the understanding of the position of the engagement projection 321, in FIG. 11A, the receptacle protection cover 3 is illustrated with the outer side face 32 facing upward; however, in practice, the receptacle protection cover 3 is inserted into the concave part 21 in a state where the inner side face 31 faces upward. Because the position of the engagement projection 321 and the position of the engagement concave part 217 match each other, the engagement projection 321 and the engagement concave part 217 can engage with each other. FIG. 11B is a diagram illustrating a state where the other end side of a receptacle protection cover is being inserted into a concave part. To facilitate the understanding of the positions of the engagement projections 322 and 323, in FIG. 11B, the receptacle protection cover 3 is illustrated with the outer side face 32 facing upward; however, in practice, the receptacle protection cover 3 is inserted into the concave part 21 in a state where the inner side face 31 faces upward. Because the positions of the engagement projections 322 and 323 and the positions of the engagement concave parts 218 and 219 match each other, the engagement projections 322 and 323 and the engagement concave parts 218 and 219 can engage with each other.

Figure 12A:
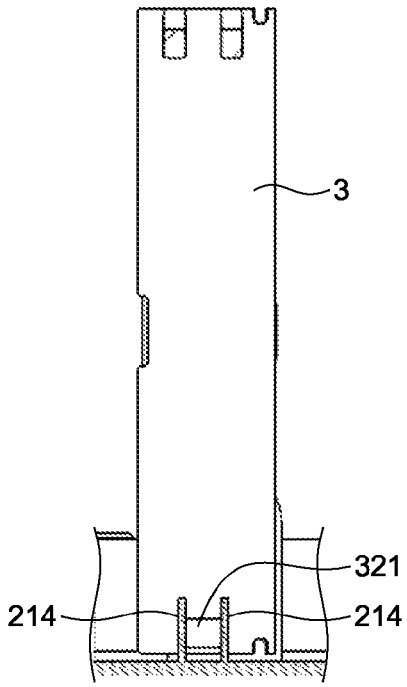
FIG. 12A is a diagram illustrating a state where a cover plate is inserted into a concave part from one end side.

When the plug 4 having been attached to the plug attachment part 312 is inserted into the receptacle 11, the cover plate 30 is inserted into the concave part 21 from the one end 3*a* side in the longitudinal direction. At this point, because the cover plate 30 is guided by causing the engagement projection 321 to be sandwiched between the guides 214, the plug 4 can be easily put through the plug insertion hole 212 provided in the bottom face 211 of the concave part 21. FIG. 12A is a diagram illustrating a state where a cover plate is inserted into a concave part from one end side. The cover plate 30 is guided by causing the engagement projection 321 to be sandwiched between the guides 214. When the cover plate 30 is inserted into the concave part 21 from the other end 3*b* side, the guides 214 inhibit the engagement projections 322 and 323 from advancing into the concave part 21; therefore, the cover plate 30 can be inserted only part-way into the concave part 21.

Figure 12B:
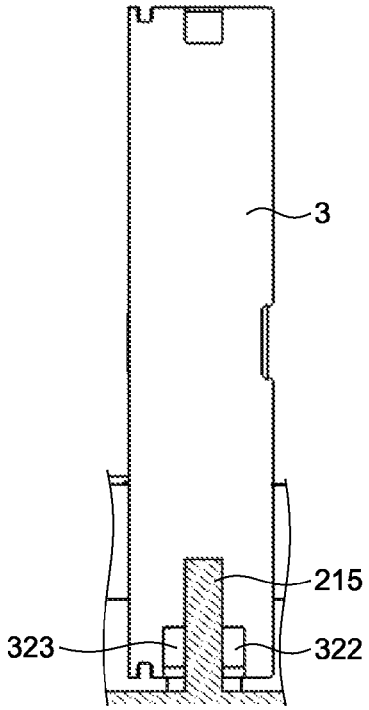
FIG. 12B is a diagram illustrating a state where a cover plate is inserted into a concave part from the other end side.

Similarly, when the plug 5 having been attached to the plug attachment part 313 is inserted into the receptacle 12, the cover plate 30 is inserted into the concave part 21 from the other end 3*b* side in the longitudinal direction. At this point, because the cover plate 30 is guided by causing the guide 215 to be sandwiched between the engagement projections 322 and 323, the plug 5 can be easily put through the plug insertion hole 213 provided in the bottom face 211 of the concave part 21. FIG. 12B is a diagram illustrating a state where a cover plate is inserted into a concave part from the other end side. The cover plate 30 is guided by causing the guide 215 to be sandwiched between the engagement projections 322 and 323. When the cover plate 30 is inserted into the concave part 21 from the one end 3*a* side, the guide 215 inhibits the engagement projection 321 from advancing into the concave part 21; therefore, the cover plate 30 can be inserted only partway into the concave part 21.

Figure 13A:
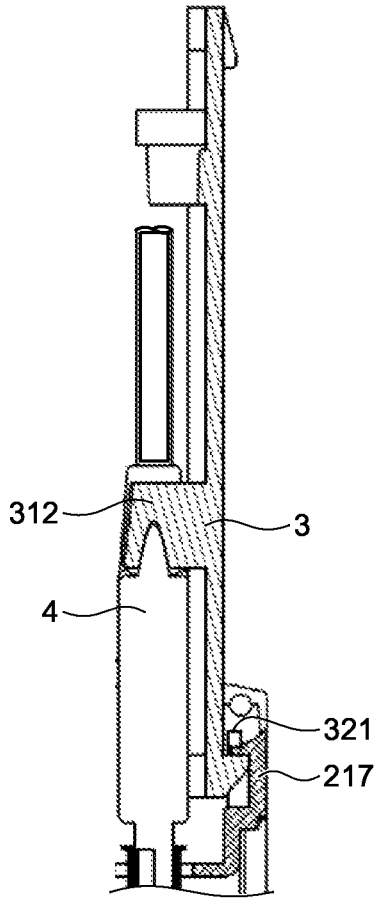
FIG. 13A is a diagram illustrating a state where a receptacle protection cover having been inserted into a concave part from one end side is fixed to a front cover.
Figure 13B:
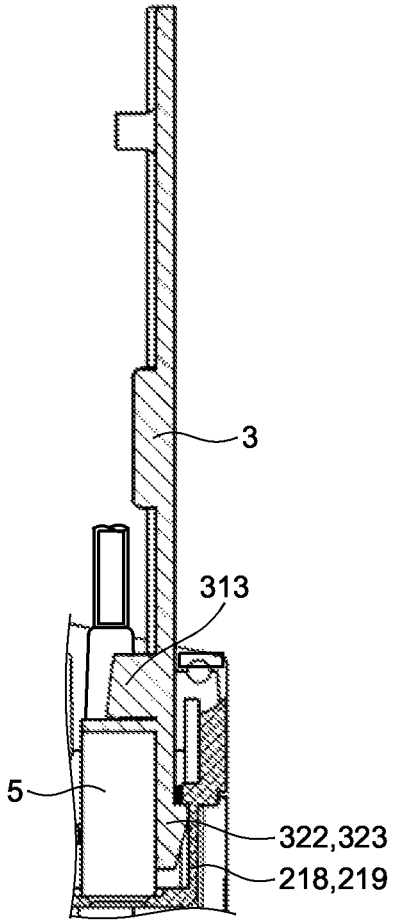
FIG. 13B is a diagram illustrating a state where a receptacle protection cover having been inserted into a concave part from the other end side is fixed to a front cover.

When the cover plate 30 is inserted deep enough to have the plug 4 inserted into the receptacle 11, the engagement projection 321 and the engagement concave part 217 engage with each other, and the receptacle protection cover 3 is fixed to the front cover 2. With this configuration, the plug 4 is locked in a state where the plug 4 is inserted into the receptacle 11. FIG. 13A is a diagram illustrating a state where a receptacle protection cover having been inserted into a concave part from one end side is fixed to a front cover. As is the case of the above configuration, when the cover plate 30 is inserted deep enough to have the plug 5 inserted into the receptacle 12, the engagement projections 322 and 323 and the engagement concave parts 218 and 219 engage with each other, and the receptacle protection cover 3 is fixed to the front cover 2. With this configuration, the plug 5 is locked in a state where the plug 5 is inserted into the receptacle 12. FIG. 13B is a diagram illustrating a state where a receptacle protection cover having been inserted into a concave part from the other end side is fixed to a front cover.

In the above descriptions, a case where an electronic device including two receptacles having different shapes has been exemplified; however, it is also permissible that the electronic device includes only one receptacle (or one type of receptacle). In this case, it suffices that one plug attachment part is provided in the receptacle protection cover.

According to the present embodiment, because a plug can be inserted into a receptacle while a receptacle protection cover is held by a user, even if the concave part is deep and the user's fingers cannot reach enough into the concave part, the plug can be easily inserted into the receptacle.

Even when the electronic device includes two types of receptacles having different shapes, it is still possible to accommodate the two plug shapes with a single protection cover.

When a plug is inserted into a receptacle, an engagement projection is guided to an engagement concave part along a guide; therefore, the plug can be easily inserted into the receptacle. Thus, erroneous insertion of a plug and damage to the receptacle and the plug due to such erroneous insertion can be prevented.

When a plug is inserted into a receptacle, the plug is locked due to the engagement between an engagement projection and an engagement concave part, and thus it is possible to prevent erroneous operations and malfunctions of a device due to the plug coming out of the receptacle during communication.

INDUSTRIAL APPLICABILITY

As described above, the receptacle protection cover and the electronic device according to the present invention are useful in terms of enabling a plug to be easily connected to a receptacle that is provided in a concave part, which is provided in a casing of an electronic device and has a narrow width.

REFERENCE SIGNS LIST

1 electronic device, 2 front cover, 3 receptacle protection cover, 3*a* one end, 3*b* other end, 4, 5 plug, 11, 12 receptacle, 21 concave part, 30 cover plate, 31 inner side face, 32 outer side face, 41, 51 terminal part, 42, 52 housing, 43, 53 cable part, 211 bottom face, 212, 213 plug insertion hole, 214, 215 guide, 216 shaft part, 217, 218, 219 engagement concave part, 220 inner wall, 311 bearing part, 312, 313 plug attachment part, 314 end part, 321, 322, 323 engagement projection, 421, 521 tension relieving part.

The invention claimed is:

1. A receptacle protection cover that is attachable to and detachable from a casing of an electronic device including a receptacle into which a plug is inserted, the receptacle protection cover comprising:

a rectangular plate-shaped cover plate; and a plug attachment part that is provided on one face of the cover plate and that fixes the plug such that a terminal part of the plug projects from an end part of the cover plate in a longitudinal direction, wherein with the receptacle protection cover attached to the casing and oriented in a first orientation relative to the casing, the receptacle protection cover protects the receptacle provided in a concave part by covering the concave part formed in the casing, and with the receptacle protection cover detached from the casing and oriented in a second orientation relative to the casing, the second orientation being different from the first orientation and not parallel to the first orientation, the receptacle protection cover serves as a jig for inserting the plug attached to the plug attachment part into the receptacle.

2. The receptacle protection cover according to claim 1, wherein the receptacle protection cover is used in an electronic device including two receptacles having different shapes, two plug attachment parts are provided on one face of the cover plate while corresponding to plugs to be respectively inserted into the two receptacles, and when the plugs have been attached to the corresponding plug attachment parts, a terminal part projects from an end of the cover plate in the longitudinal direction.

3. The receptacle protection cover according to claim 2, comprising an erroneous-attachment prevention projection that inhibits the plug having a non-matching shape from being attached to the plug attachment part.

4. An electronic device that comprises a casing including a concave part and a receptacle protection cover that covers the concave part and is attachable to and detachable from the casing, and in which two receptacles into which two plugs having different shapes are respectively inserted are provided in the concave part, wherein the receptacle protection cover includes a rectangular plate-shaped cover plate, two plug attachment parts that are provided on one face of the cover plate while corresponding to plugs respectively inserted into the two receptacles, and that fix the plugs such that a terminal part of the corresponding plug projects from one end or another end of the cover plate in a longitudinal direction, and projections that are provided on both ends on another face of the cover plate in a longitudinal direction so as to have different arrays on one end side and another end side, the casing includes, at positions where the receptacles are provided in the concave part, a guide that guides a projection on one of the one end side and the another end side of the cover plate and that inhibits a projection on another of the one end side and the another end side of the cover plate from advancing, and at the positions where the receptacles are provided in the concave part, the receptacle protection cover is capable of being inserted only from a side where the terminal part of a plug corresponding to the receptacle provided in each of the positions projects.

5. The electronic device according to claim 4, wherein the casing includes, in the concave part, an engagement concave part that engages with the projection in a state where the plug is inserted into the receptacle.

6. A receptacle protection cover that is attachable to and detachable from a casing of an electronic device including a receptacle into which a plug is inserted, and that protects the receptacle provided in a concave part by covering the concave part formed in the casing, the receptacle protection cover comprising:

a rectangular plate-shaped cover plate; and a plug attachment part that is provided on one face of the cover plate and that fixes the plug such that a terminal part of the plug projects from an end part of the cover plate in a longitudinal direction, wherein as the receptacle protection cover is detached from the casing, the receptacle protection cover serves as a jig for inserting the plug attached to the plug attachment part into the receptacle, the receptacle protection cover is used in an electronic device including two receptacles having different shapes that are a first receptacle to which a first plug is inserted and a second receptacle to which a second plug is inserted, a first plug attachment part corresponding to the first plug is provided on the one face of the cover plate, a second plug attachment part corresponding to the second plug is provided on the one face of the cover plate, when the first plug is attached to the first plug attachment part, a terminal part of the first plug projects from one end of the cover plate in a longitudinal direction, and when the second plug is attached to the second plug attachment part, a terminal part of the second plug projects from the other end of the cover plate in the longitudinal direction.

7. The receptacle protection cover according to claim 6, comprising an erroneous-attachment prevention projection that has a shape matching the first plug and inhibits the second plug having a non-matching shape from being attached to the first plug attachment part.

* * * * *